US005660291A

United States Patent [19]

Dash

[11] Patent Number: 5,660,291

[45] Date of Patent: Aug. 26, 1997

[54] COLLAPSIBLE CAGE

[76] Inventor: Alan Dash, 3 Bilkurra Place, Niagara Park, New South Wales, 2250, Australia

[21] Appl. No.: 211,194

[22] PCT Filed: Sep. 24, 1992

[86] PCT No.: PCT/AU92/00514

§ 371 Date: Feb. 21, 1995

§ 102(e) Date: Feb. 21, 1995

[87] PCT Pub. No.: WO93/06017

PCT Pub. Date: Apr. 1, 1993

[30] Foreign Application Priority Data

Sep. 24, 1991 [AU] Australia ..... PK8513
Apr. 29, 1992 [AU] Australia ..... PL2134

[51] Int. Cl.[6] ..... B65D 88/52
[52] U.S. Cl. ..... 220/6; 200/336
[58] Field of Search ..... 220/6, 7, 4.08, 220/4.09, 336; 206/503, 600

[56] References Cited

U.S. PATENT DOCUMENTS

| | | | |
|---|---|---|---|
| 1,352,299 | 9/1920 | Mertz . | |
| 3,497,127 | 2/1970 | Box | 220/6 |
| 4,005,795 | 2/1977 | Mikkelsen et al. | 220/6 |
| 4,170,313 | 10/1979 | Caves et al. | 220/6 |
| 4,266,670 | 5/1981 | Mykleby | 220/6 |
| 4,735,330 | 4/1988 | Hoss | 220/6 |
| 4,775,068 | 10/1988 | Reiland et al. | 220/6 |
| 4,917,255 | 4/1990 | Foy et al. | 220/6 |
| 4,960,223 | 10/1990 | Chiang et al. | 220/6 |

FOREIGN PATENT DOCUMENTS

| | | |
|---|---|---|
| 2117335 | 2/1936 | Australia . |
| 495637 | 4/1939 | Australia . |
| 1514852 | 3/1953 | Australia . |
| 6364160 | 2/1961 | Australia . |
| 1933870 | 10/1971 | Australia . |
| 1471570 | 11/1971 | Australia . |
| 4991372 | 6/1974 | Australia . |
| 1169776 | 9/1977 | Australia . |
| 1666283 | 1/1984 | Australia . |
| 4511785 | 1/1987 | Australia . |
| 1947988 | 12/1988 | Australia . |
| 2052788 | 2/1989 | Australia . |
| 3480089 | 11/1989 | Australia . |
| 8542091 | 4/1992 | Australia . |
| 912794 | 6/1954 | Germany . |
| 4025957 | 2/1992 | Germany . |

OTHER PUBLICATIONS

Derwent Abstract Accession No. 90–273607/36 Apr. 4,1983 "Multiple Folding Container – Spring Catches at Each Corner are Released by Rotating Cranks".

*Primary Examiner*—Joseph M. Moy
*Attorney, Agent, or Firm*—Abelman, Frayne & Schwab

[57] ABSTRACT

A collapsible cage has a base upon which is supported a plurality of side panels and top panel. The assembled cage has its side panels in an upright position with the top panel located thereover, the panels being locked into their positions by locking means. The side panels and top panel may be collapsed so that they assume a substantially horizontally stacked position over the base by operation of the collapsing means. The locking means comprises a vertically displaceable member having a catch means mounted on a first panel and a recessed portion on an adjacent second panel for receiving the catch means. A vertical rod connected to the displaceable member extends downwardly to engage an opening in the base of the cage. Collapsing is achieved by pivoting each pair of adjacent side panels into coplanar relationship, and then each coplanar pair to the base. Hinges pivoting adjacent panels are double hinges allowing a panel to pivot 90° inwards to lay on the inside of the adjacent panel or 270° outward to lay on the outside of the adjacent panel. The top panel has a slide and hinge arrangement to allow the top panel to be parallel with and on the outside of a side panel before pivoting of the side panel to the collapsed position.

13 Claims, 10 Drawing Sheets

COLLAPSIBLE CAGE

FIELD OF THE INVENTION

The present invention relates to collapsible cages useful for the transportation or storage of a wide variety of items.

BACKGROUND ART

The transportation of goods in containers to a destination is often followed by the return of the containers, empty of goods, to their source.

The empty containers are conventionally returned in their original shape and take up the same carrying area or volume on the transportation vehicle as they had when they were loaded with goods.

It would be advantageous if the containers, once emptied, where reduced in overall size so that the transportation vehicle were able to carry a greater number of containers or allocate carrying space to goods for the return journey.

It is an object of the present invention to overcome substantially ameliorate the shortcomings of the prior art.

DISCLOSURE OF THE INVENTION

According to the invention there is provided a collapsible cage comprising a base, a plurality of side panels adapted to be supported on the base in both an upright and collapsed position, locking means adapted to allow the panels to be locked into and unlocked from their upright position when forming the cage, and collapsing means adapted to allow the panels to be collapsed and assume a substantially horizontally stacked position over the base.

In a preferred form of the invention, the collapsible cage includes a top panel adapted to be supported oh the side panels when in an upright position, wherein the top panel is lockable by locking means and collapsible by collapsing means so that the side panels and top panel can assume a substantially horizontally stacked position over the base.

The locking means preferably comprises a lockable member mounted on a first panel and a recessed portion on an adjacent second panel, the lockable member including catch means adapted to engage within the recessed portion, thereby locking the first panel to the adjacent second panel.

The collapsible cage of the invention may also include Guide means adapted to cooperate with the locking means, whereby the guide means ensure that the panels are properly orientated in their cage forming position before the panels are locked or unlocked by the locking means.

It is also preferred that the collapsing means includes means for pivoting a first side panel about an adjacent second side panel so that the said first and second side panels are substantially coplanar to each other and means for lowering the substantially coplanar panels onto the base, so that the panels assume a substantially horizontally stacked position over the base.

Preferably, the pivoting means includes double axis hinge means that provide a first axis of rotation of the first side panel about the second side panel to enable the first side panel to pivot to a first outer position and a second axis of rotation of the first side panel about the second side panel to enable the first side panel to pivot from the first outer position to a second outer position where the said first and second side panels are substantially coplanar to each other.

BRIEF DESCRIPTION OF THE DRAWINGS

In order that the invention may be more readily understood and put into practical effect, reference will now be made to the accompanying drawings, in which.

DESCRIPTION OF PREFERRED EMBODIMENT

Figure 1:
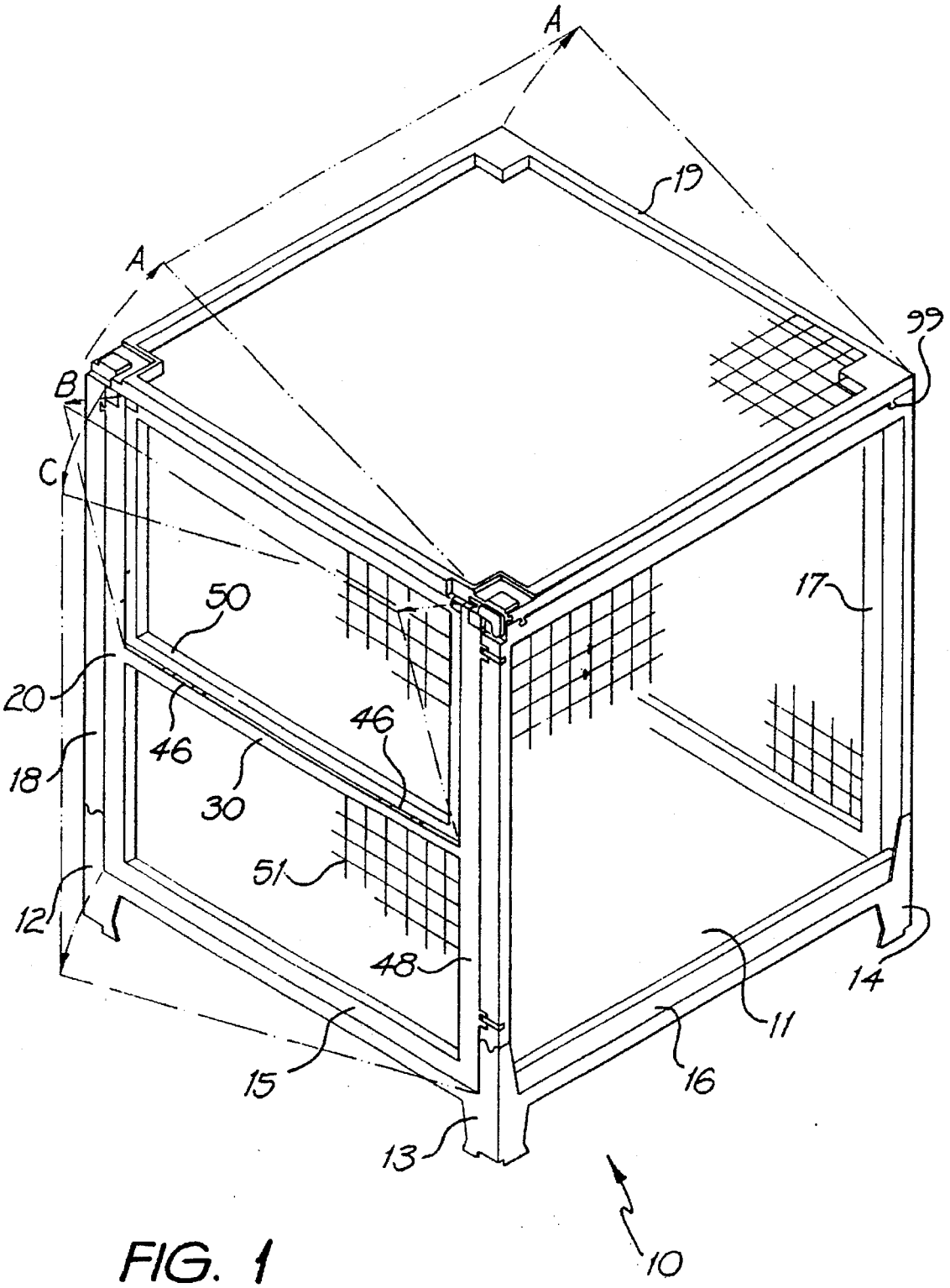
FIG. 1 is an isometric view of a collapsible cage according to a first embodiment of the invention.

The cage 10 of FIG. 1 has a square base 11 at each corner of which is a support member (only 12, 13 and 14 shown) that cooperatively support the cage 10 on a surface. The cage 10 has four side panels 15, 18, 17 and 18 and a top panel 19 that is shown by arrows A pivoting upwardly around the upper edge of panel 16.

The panel 15 differs from the other side panels of the cage 10 of FIG. 1 in that it is hinged along a horizontal axis at its midline extending between the panel side members 20 and 48. Located between the panel side members and 48 are top and bottom subpanels 50 and 51 respectively. The top subpanel 50 is pivotally interconnected to a midline frame member 30, which supports the meshwork of panel 51, by a pair of opposed double acting hinges 46 that enable the top subpanel 50 to pivot outwardly and downwardly as shown by arrow B so that the top subpanel 50 can become parallel with the bottom subpanel 51. The panel side members 20 and 48 of the panel 15 are stationary during this operation.

Figure 12:
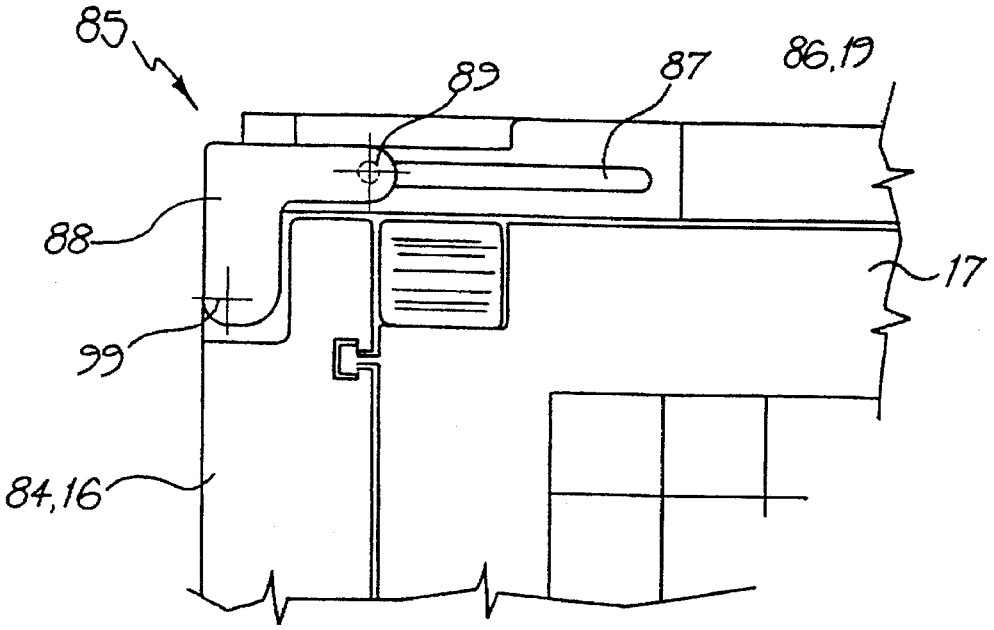
FIG. 12 is a side view of a slide and hinge assembly for the top panel of the cage of FIG. 1.
Figure 13:
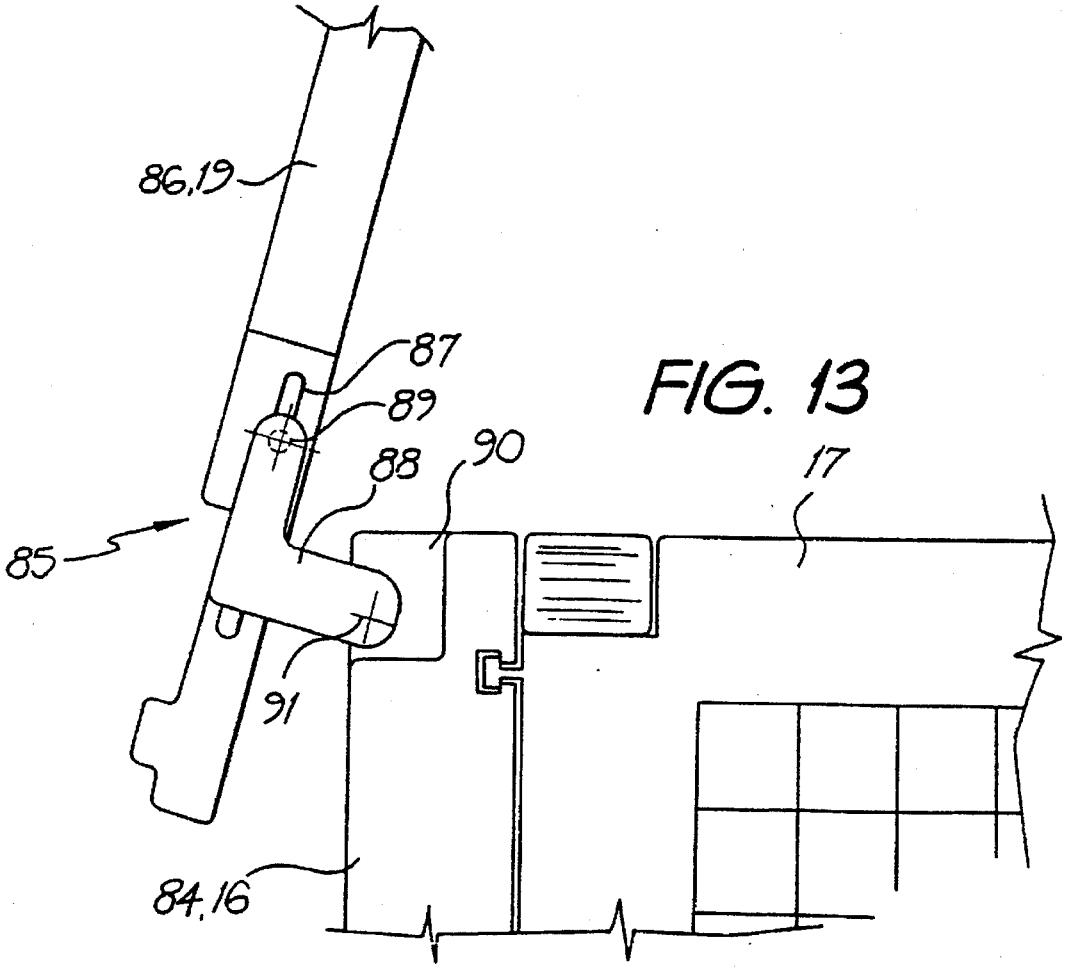
FIG. 13 is a side view of the slide and hinge assembly of FIG. 12 being pivoted about a side panel of the cage of FIG. 1.

Although the cage 10 of FIG. 1 is shown with a top panel 19, a top panel is optional. The preferred pivoting mechanism of the top panel 19 is shown in FIGS. 12 and 13, but the top panel 19 is not shown in the remaining drawings which show the locking and collapsing process as it relates to a cage, such as that shown in FIG. 4, having a base and side panels only.

Figure 4:
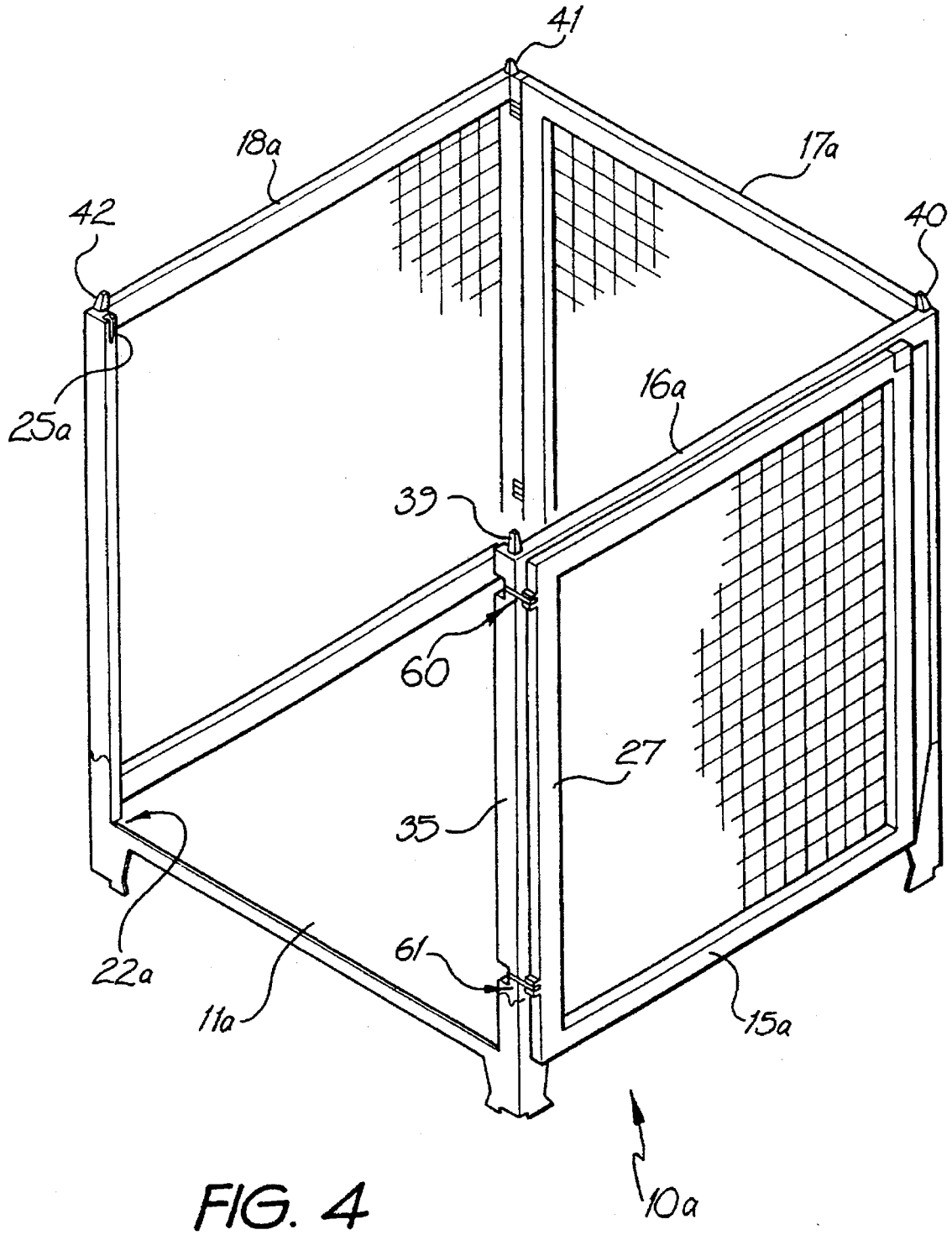
FIG. 4 is an isometric view of a collapsible cage according to a second embodiment of the invention showing a side panel having been pivoted outwardly.

Referring to the cage 10*a* of FIG. 4, at opposite ends of the upper surface of each of the panels 16*a* and 18*a* are male projections 39, 40, 41 and 42 that are adapted to be received within complimentary female cavities located at the underside of the support members so as to facilitate the stacking of assembled cages.

Generally, in order to collapse the cage 10*a* of FIG. 4, the panel 15*a* is unlocked from its engagement with panel 18*a* and then pivoted to a position, as shown, where it is substantially coplanar with or parallel to the panel 16*a* and on the outside of the cage 10*a*. Similarly, in order to collapse the cage 10 shown in FIG. 1, the panel 15 must be unlocked from its engagement with panel 18 and then pivoted (as shown by arrow C) to a similar position to that of panel 15*a* shown in FIG. 4.

Figure 2:
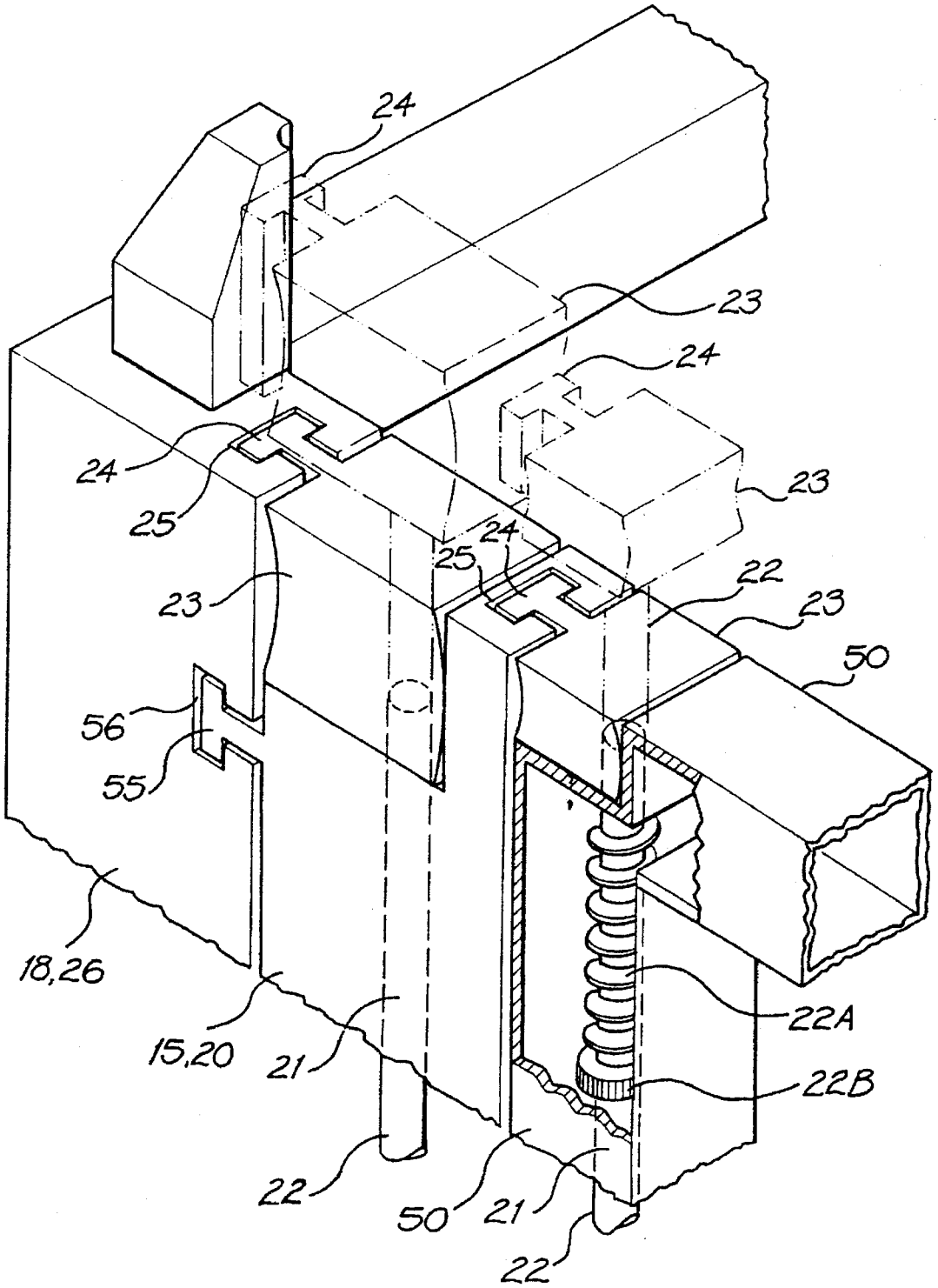
FIG. 2 is an isometric top view of a locking arrangement for the collapsible cage of FIG. 1.

The following is a description of the locking arrangement and of how the panel 15 is unlocked from the panel 18 of cage 10 of FIG. 1 with particular reference being made to FIG. 2. Although FIG. 2 also shows the locking arrangement between the panel 15 and top subpanel 50 of cage 10 shown in FIG. 1, reference may also be made to FIG. 2 to illustrate the locking arrangement for the panel 15*a* to panel 18*a* of cage 10*a* of FIG. 4.

The panel side member 20 of panel 15 has a tubular passageway 21 extending the full length thereof and through which passes a rod 22. The rod 22 is spring mounted such that, when it is raised upwardly, it has a bias to resume its original lower position. When in its lower position, the lower end of the rod 22 engages an opening such as hole 22*a* shown in FIG. 4 in the base 11*a*.

At the upper end of the rod 22 is a lifting member 23 adapted to be gripped so as to raise the rod 22. The lifting member 23 has a catch portion 24 integral therewith that is adapted to fit within a correspondingly shaped recess 25, also shown as recess 25*a* in FIG. 4, located on panel side member 26 of panel 18.

When the catch portion 24 is to be removed from the recess 25, the rod 22 must be raised against the force of the spring therefore 22A located in the passageway 21 rod 22. The bottom end of spring 22A rests against a platform 22B projecting out of the rod. When the catch portion 24 is clear of the recess 25, the opposite end of the rod 22 is also clear of the hole (22*a*) in the base 11 and so the cage 10 can be opened between these panels 15 and 18 by pivoting about the opposite side of the panel 15 as shown by arrow C in FIG. 1.

The side member 20 of panel 15 also has a guide 55 formed integrally therewith. The side member 26 of panel 18 has an aperture 56 extending the full width thereof and shaped so as to receive the guide 55 therethrough.

The fit of the guide 55 within the aperture 56 is sufficiently close that it eliminates any significant vertical movement of the side of the panel 15 about the adjacent side member 26 of panel 18 and also acts as a means for ensuring that the catch portion 24 is correctly aligned with and fits into recess 25.

The aforementioned locking arrangement is also suitable for locking the panel 15*a* to panel 18*a* of the cage 10*a* of FIG. 4.

An identical locking arrangement exists between adjacent panel side members of locking panels 16 and 16*a* and their respective pivoting panels 17 and 17*a*.

FIG. 2 also shows the locking arrangement between the top subpanel 50 and the panel side member 20 of panel 15. This arrangement is similar to the locking arrangement between the panel side member 20 of panel 15 and panel side member 26 of panel 18 described above, with the only significant difference being the absence of an aperture and guide arrangement. An aperture and guide arrangement similar to that between panel side members 20 and 26 may be used between the side member of top subpanel 50 and panel side member 20 but the aperture should not extend the full width of the side member 20 but should terminate before it emerges at the rear surface thereof. Such an arrangement will ensure that the top subpanel 50 can only pivot outwardly and not inwardly. The numerals used in relation to the locking arrangement between the panel side members 20 and 26 are used to identify identical features in the locking arrangement between the top subpanel 50 and panel side member 20.

The following is a description of the identical vertical pivoting arrangement for panels 15*a* and 17*a* of the cage 10*a* of FIG. 4, with particular reference being made in the description to FIGS. 3 to 9 and how the unlocked panel 15*a* may be pivoted against either the inside or outside of the panel 16*a*. The same vertical pivoting arrangement may be used to pivotally open an unlocked panel 15 against the outside of panel 16 of the cage 10 of FIG. 1.

The pivoting arrangement for panel 15*a* enables the panel 15*a* to vertically pivot about 360° of angle. In FIG. 4, the panel 15*a* is shown to have pivoted about 270° of angle from its closed cage forming position to a pre-lowering position where it is adjacent and substantially coplanar or parallel with the panel 16*a* and on the outside of the cage 10*a*. The panel 15*a* can also pivot 90° inwardly from its closed cage forming position so as to be coplanar with and on the inside of panel 16*a*.

There are two identical pivoting hinge assemblies 60 and 61 for panel 15*a*, both connecting between the panel side member 35 of panel 16*a* and panel side member 27 of panel 15*a*. Identical pivoting hinge assemblies are used to pivotally connect the panel 15 to panel 16 of the cage 10 of FIG. 1.

Each pivoting hinge assembly 60 and 61 has double action pivoting axes whereby the panel 15*a* initially pivotally opens about a first pivoting axis and thereafter, to bring it into parallel alignment with and to the outside of panel 16*a*, pivots about a second pivoting axis.

Figure 3:
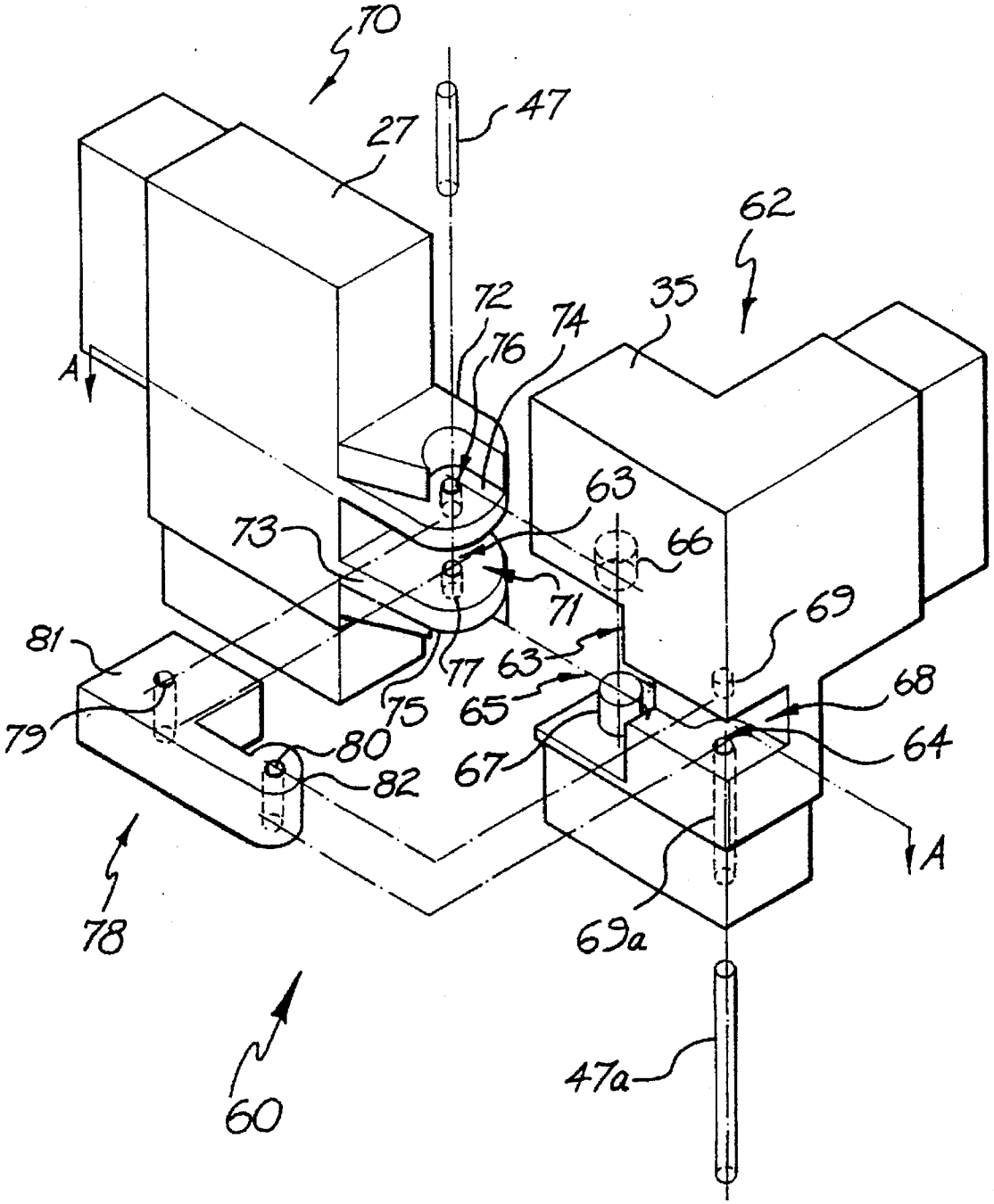
FIG. 3 is an exploded isometric view of a pivoting hinge assembly for the cage of FIGS. 1 and 2.

Pivoting hinge assembly 60 is shown in its exploded or disassembled state in FIG. 3. A first hinge portion 62 is part of panel side member 35, a second hinge portion 70 is part of panel side member 27, and a third hinge portion 78 comprises a connecting member between the first hinge portion 62 and second hinge portion 70.

The first hinge portion 62 has a first hinge connector receiving cavity 65 and a pair of opposed guide lugs 66 and 67 therewithin, that define a first vertical pivoting axis 63 therebetween. There is a second hinge connector receiving cavity 68 having openings top and bottom to opposed tubular passageways 69 and 69*a* sharing a second vertical pivoting axis 64 (shown in FIGS. 5 to 9). The second hinge portion 70 has a third hinge connector receiving cavity 71 having a pair of opposed lock arms 72 and 73. Arm 72 has an upper recessed landing 74 adapted to slide behind and receive guide lug 66 of first hinge portion 62. Arm 73 has a lower recessed landing 75 adapted to slide behind and receive guide lug 67 of first hinge portion 62. The arrangement of recessed landings 74 and 75 and guide lugs 66 and 67 serves to prevent instability of the pivoting panel about the stationary panel.

Arms 72 and 73 also have opposed tubular passageways 76 and 77 sharing the first pivoting axis 63.

Shown in relation to the third hinge portion 78 is the first pivoting axis 63 and the second pivoting axis 64. Centred about both axes 63 and 64 in third hinge portion 78 are tubular passageways 79 and 80 respectively.

The third hinge portion 78 acts as a double hinged connector plate and has a major member 81 adapted to fit between the arms 72 and 73 of second hinge portion 70 so that the passageway 79 is axially aligned with passageways 76 and 77, thereby allowing the third hinge portion 78 and the second hinge portion 70 to pivot about each other around axis 63 when a cylindrical shaft 47 is located through these passageways.

The third hinge portion 78 also has a minor member 82 adapted to fit within cavity 88 of first hinge portion 62 so that the passageway 80 is axially aligned with passageways 69 and 69*a*, thereby allowing the third hinge portion 78 and the first hinge portion 62 to pivot about each other around axis 64 when a cylindrical shaft 47*a* is located through these passageways.

When the first, second and third hinge portions 62, 70 and 78 respectively, are assembled by way of the connecting cylindrical shafts, the unlocked panel 15*a* can initially pivot outwardly about first pivoting axis 63 and then pivot outwardly about pivoting axis 64 to bring it into parallel alignment with panel 16*a*.

Figure 6:
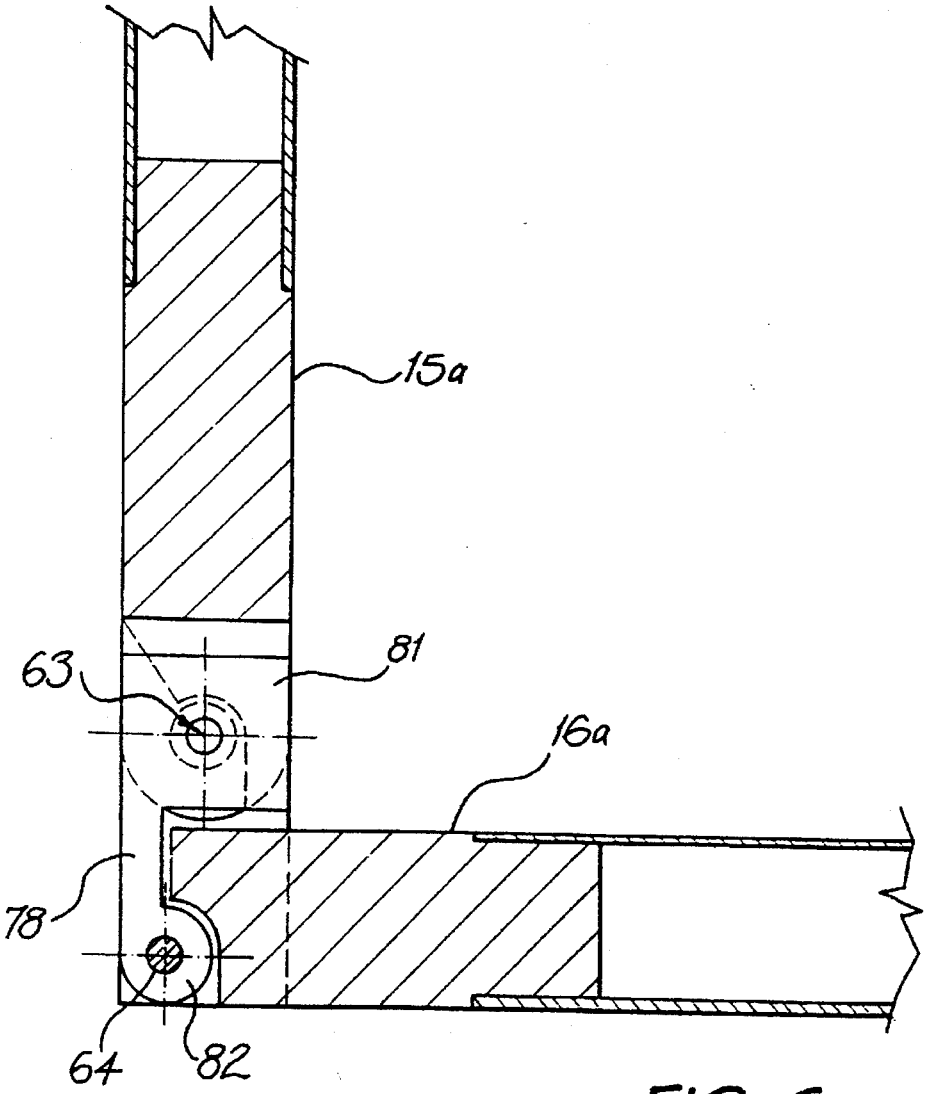
FIG. 6 is a sectional top view through AA of the pivoting hinge assembly of FIG. 3 when the hinge assembly is supporting panels at a closed cage orientation of 90° to each other.

The sectional view shown in FIG. 6 is through line AA of the hinge assembly 60 when assembled and supporting panels 15*a* and 16*a* of a cage 10*a* that is closed.

The cage 10*a* may be opened by pivoting the unlocked panel 15*a* from its position as shown in FIG. 6 either into the cage or out of the cage.

Figure 5:
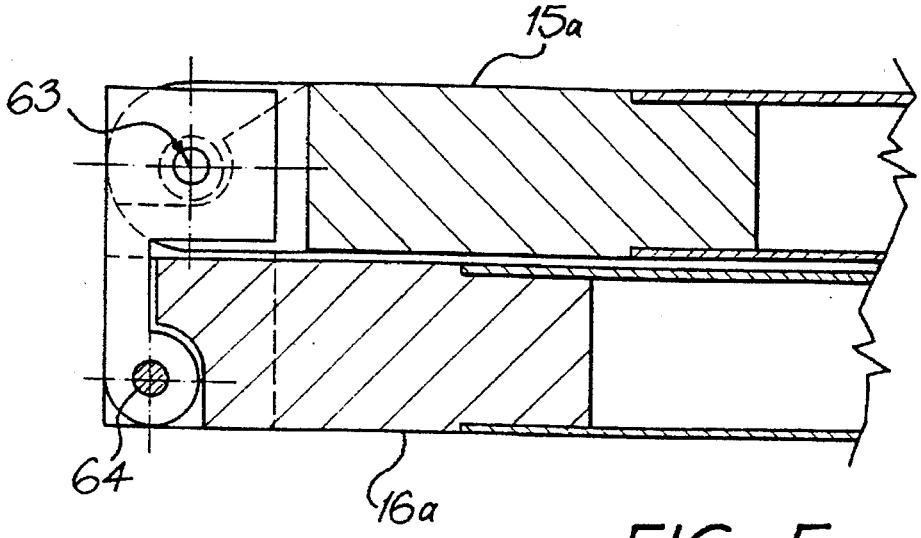
FIG. 5 is a sectional top view through AA of the pivoting hinge assembly of FIG. 3 when the hinge assembly is supporting coplanar panels at a first open cage orientation of 0° to each other.

Pivoting the unlocked panel 15*a* into the cage can allow the panel 15*a* to rest coplanar with and on the inside of panel 16*a*, as shown in FIG. 5. This movement is achieved by the panel 15*a* pivoting inwardly about axis 63.

Figure 7:
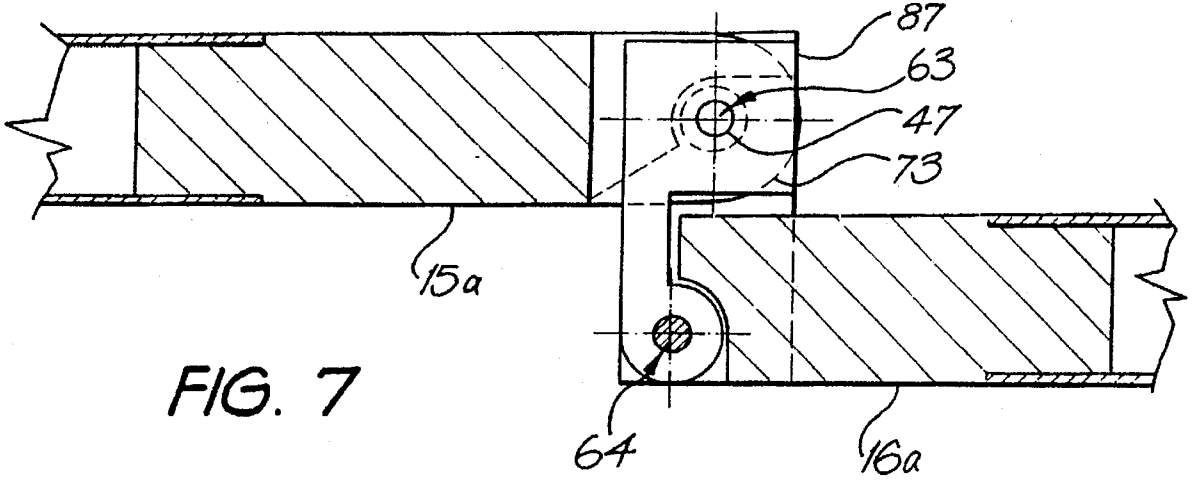
FIG. 7 is a sectional top view through AA of the pivoting hinge assembly of FIG. 3 when the hinge asembly is supporting panels at a second open cage orientation of 180° to each other.
Figure 8:
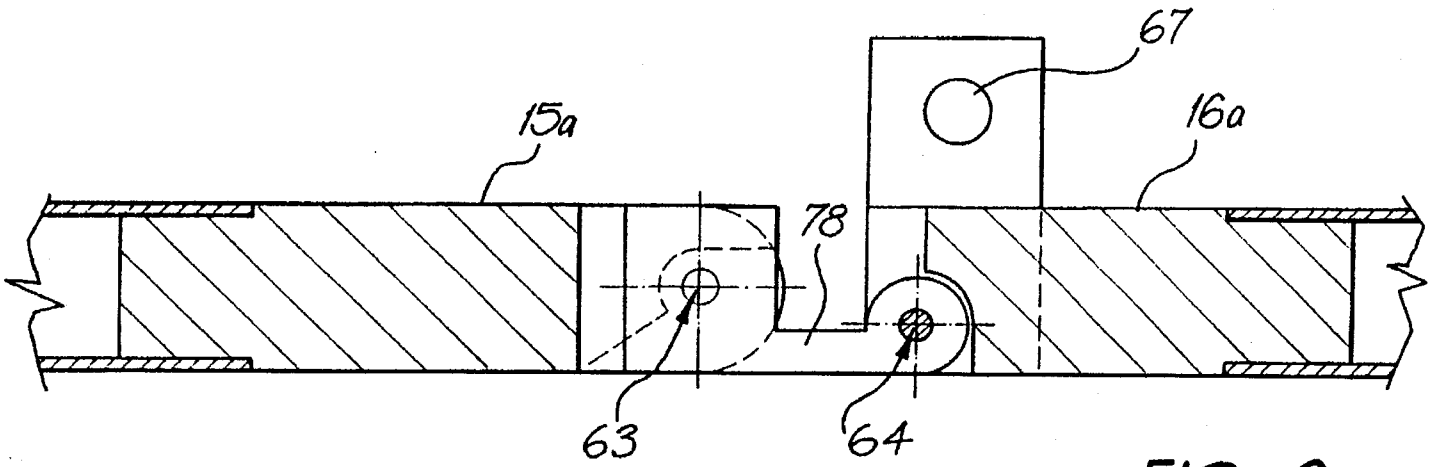
FIG. 8 is a sectional top view through AA of the pivoting hinge assembly of FIG. 3 when the hinge assembly is supporting panels at a third open cage orientation of 180° to each other.
Figure 9:
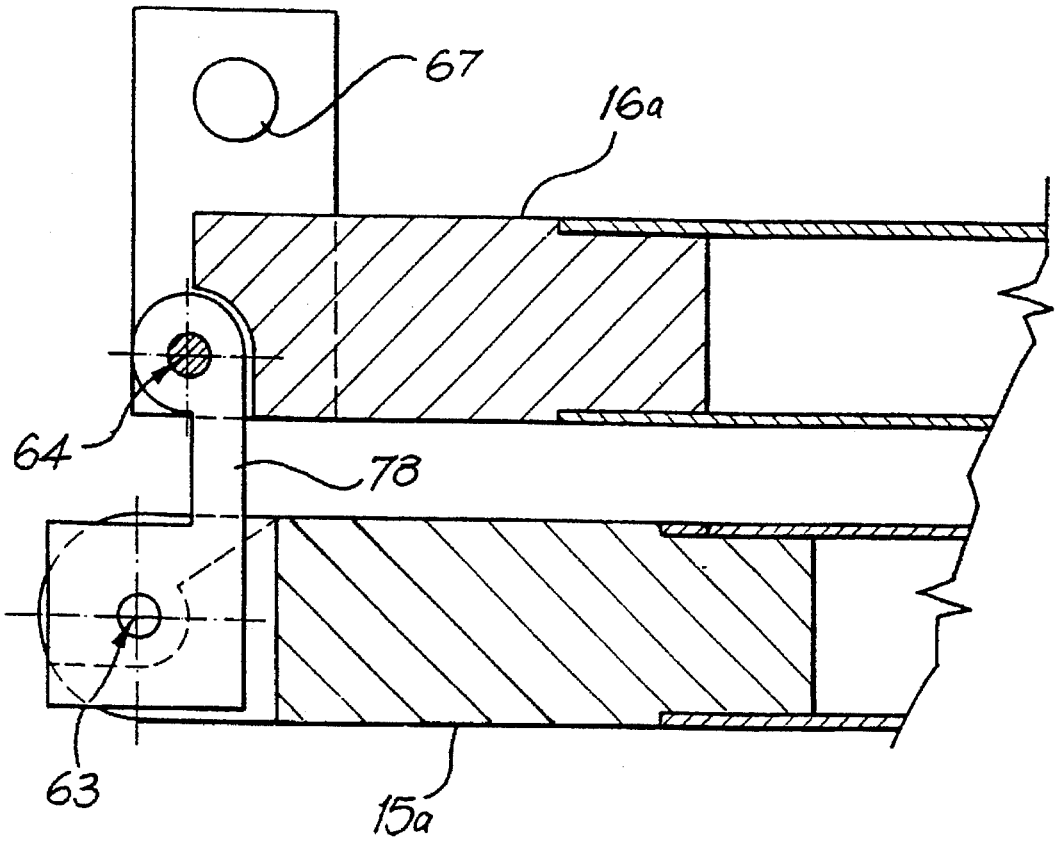
FIG. 9 is a sectional top view through AA of the pivoting hinge assembly of FIG. 3 when the hinge assembly is supporting coplanar panels at a fourth open cage orientation of 360° to each other.

Pivoting the unlocked panel 15*a* outwardly from the cage entails a series of pivoting actions about both axes 63 and 64 as shown in FIGS. 7 to 9.

In FIG. 7, the panel 15*a* has been pivoted outwardly about axis 63 from its closed position (as shown in FIG. 6) by 90° of angle so that it is in line with the stationary panel 16*a*. Further pivoting in the same direction about axis 63 is prohibited by the recessed location of axis 63 with respect to the adjacent outer corner of panel 16*a*.

Outward pivotal movement of panel 15*a* can only continue if the opposed lock arms 72 and 73 and major member 81, which are pivotally interconnected by shaft 47, are moved out from the first hinge connector receiving cavity 65. This is achieved by causing the panel 15*a* to pivot about axis 64 so that it assumes a position as shown in FIG. 8, thereby exposing the cavity 65 and the opposed guide lugs 66 and 67.

Further outward pivotal movement of panel 15*a* can now continue as the panel 15*a* is free to move by pivoting of the third hinge portion 78 about axis 64. Such further pivoting of panel 15*a* allows the third hinge portion 78 to pivot about axis 64 by another 90° of angle and the panel 15*a* itself to pivot about axis 63 by another 180° of angle, so that the panel 15*a* assumes its fully opened position as shown in FIG. 9 where it is coplanar or parallel with and on the outside of panel 16*a*.

Therefore, a full 360° of angular rotation of panel 15*a* about panel 16*a* can be carried out with the pivoting hinge assembly as described above Operating through its double action pivoting axes 63 and 64 to allow the panel 15*a* to be pivoted to the inside or outside of panel 16*a*.

An identical pivoting arrangement exists between adjacent panel side members of pivoting panels 17 and 17*a* their respective receiving panels 18 and 18*a*, so as to allow panels 17 and 17*a* to be swung to the inside or the outside of their respective cages 10 and 10*a*.

The substantially parallel panels 15*a* and 16*a* and substantially parallel panels 17*a* and 18*a* of cage 10*a* may now be lowered onto the base 11*a*.

In general terms, this is achieved by having angled groove tracks recessed in each of the support members and groove track engaging members that project from the adjacent panel side member into the recessed groove tracks. Also, one of the two support members that support each of the substantially parallel panels has a depression seat formed in its upper side into which a correspondingly shaped projection of the adjacent panel side member may sit. The depression seat is located on the support member that supports the panel side members which are connected by the vertical pivoting arrangement.

Figure 10:
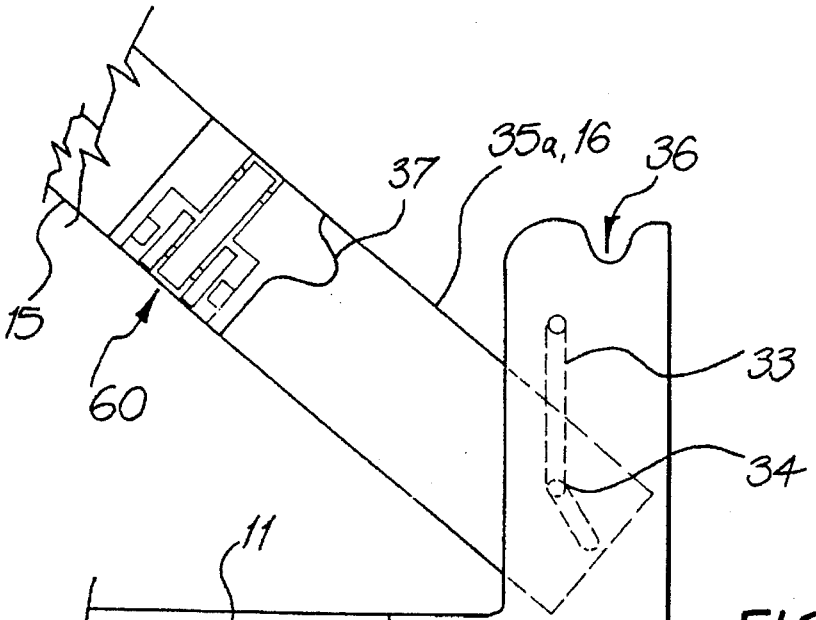
FIG. 10 is a side view of coplanar panels which are at a first open cage orientation of 0° to each other being lowered onto the base of the cage of FIGS. 1 or 4.
Figure 11:
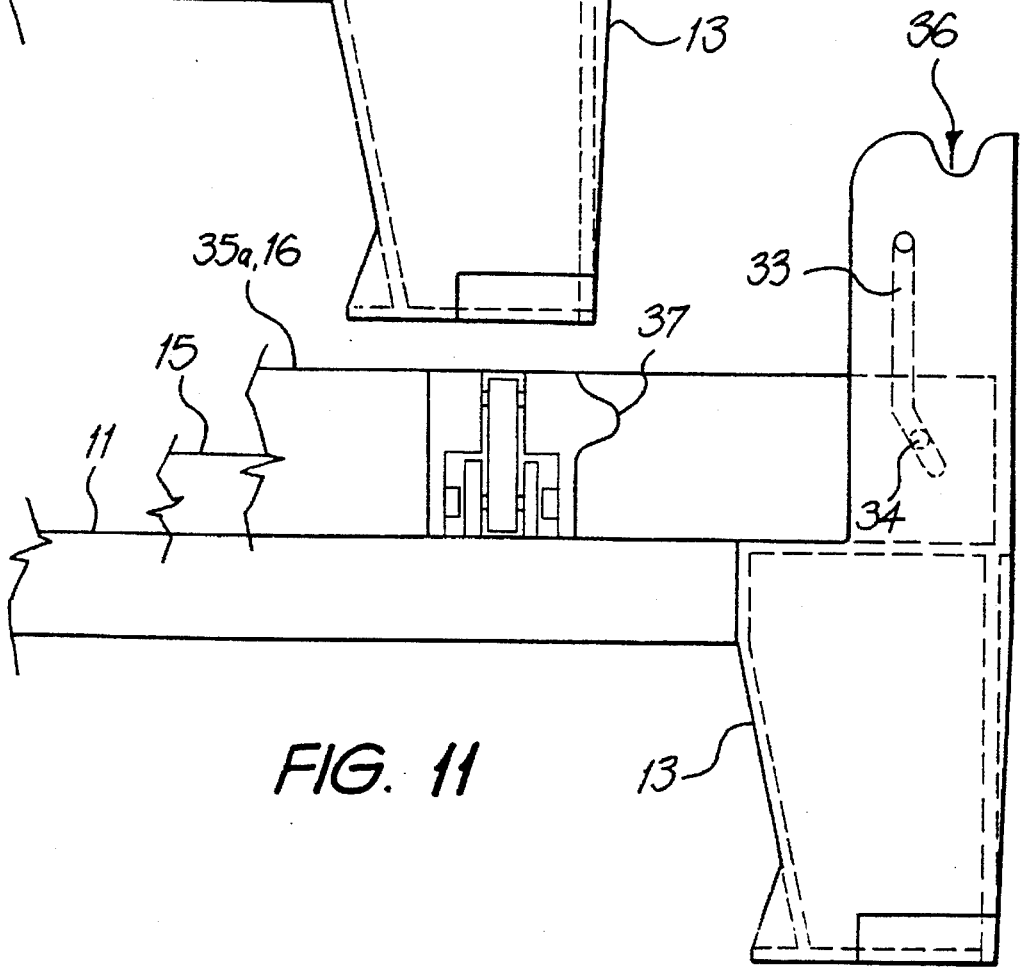
FIG. 11 is a side view of the coplanar panels of FIG. 10 resting on the base of the cage of FIGS. 1 or 4.

The following is a detailed description of the lowering arrangement and how the panels 15 and 16 of cage 10, when parallel and with panel 15 being on the inside of panel 16, may be lowered onto the base 11, with particular reference being made to FIGS. 10 and 11. FIGS. 10 and 11 also show the pivoting hinge assembly 60 in assembled form from side on.

The support member 13 has an angled groove track 33 and a depression seat 36. The groove track 33 (shown in dotted outline) is recessed into the inner surface of the support member 13. The side member 35*a* of panel 16, which is supported when standing upright by the support member 13, has a groove track engaging member 34 projecting therefrom into the groove track 33. The panel side member 35*a* has depression seat engaging projection 37. The parallel panels 15 and 16 may be raised in accordance with the member 34 following the groove track 33, However, before the parallel panels 15 and 16 can be pivoted, the parallel panels 15 and 16 must be raised to a height sufficient for the projection 37 to clear the depression seat 36. Once this has occurred, the parallel panels 15 and 16 may be pivotally lowered flat onto the base 11 as shown in FIG. 11, during which operation the groove track engaging member 34 returns downwardly through the groove track 33 to near or at the original position assumed when the panel 16 was standing upright.

An identical lowering arrangement exists for lowering parallel panels 17 and 18 onto the already lowered parallel panels 15 and 16.

Because the parallel panels 17 and 18 are rested on top of the lowered parallel panels 15 and 16, the final location of the groove track engaging member in the groove track at each of the support members that support the parallel panels 17 and 18 will be higher in the track than that shown in FIG. 11 for parallel panels 15 and 16. The angled shape of the groove track 33 enables the parallel panels 17 and 18 to be rested parallel with the parallel panels 15 and 16 so as to form a horizontally stacked arrangement of panels.

The pivoting arrangement and lowering arrangement of the panels of cage 10*a* of FIG. 4 can be functionally similar to that described for the panels of the cage 10 of FIG. 1 so as to allow the collapsed panels of cage 10*a* to assume a horizontally stacked arrangement.

When the top panel 19 is present on the cage 10 (as shown in FIG. 1) the aforementioned sequence of events is repeated with the only difference being that the top panel 19, which is pivotally connected to panel 16 by a double acting slide and hinge assembly, shown in FIGS. 12 and 13, locked at its opposite side to panel 18, must be pivotally raised to allow both the pivoting of panel 15 against panel 16 and the pivoting of panel 17 against panel 18, with the top panel 19 then being pivotally lowered through operation of the double acting slide and hinge assembly to be parallel and on the outside of the upright parallel panels 15 and 16.

The double acting slide and hinge assembly 85 shown in FIGS. 12 and 13 is located adjacent both the upper corners of panel 16.

The side panel member 86 of top panel 19 has a groove 87 and slideably engaged within the groove 87 is a projecting member 89 (shown in dotted outline) projecting inwardly from an L-shaped hinge 88.

The L-shaped hinge 88 is pivotably connected to a recessed portion 90 (shown in FIG. 13) of the panel side member 84 of panel 16 about pivoting axis 91.

In order to raise and lower the top panel 19 to be parallel and on the outside of either the upright panel 16 alone or the upright parallel panels 15 and 16, the top panel 19 is first slid horizontally in the direction from right to left with reference to FIG. 12, the sliding being controlled by the engagement of projecting member 89 with groove 87. Referring to FIG. 1, the top panel 19 has a pair of guide members 99 that engage into correspondingly shaped recesses located in the panel top member of panel 16.

When the top panel 19 has been slid horizontally a sufficient distance for the guide members 99 to clear their respective recesses in panel 16, the top panel 19 is lifted so as to pivot about pivoting axis 91. At a suitable lift angle the panel 19 is then slid upwardly so that the groove 87 reaches at or near the limit of its sliding movement set by the projecting member 89 or other appropriate position to allow the panel 19 to continue its outwardly pivoting motion. At this location, the panel 19 may be further outwardly rotated about the axis of the projecting member 89 and, as long as the side edge of panel 19 is clear of panel side member 84 of panel 16 during this rotation, the panel 19 will complete its 270° angle of rotation to be parallel with and on the outside of panel 16.

The horizontal stacking of the preferred collapsed cages of the invention on top of each other is facilitated by having an appropriately shaped female recess at the underside of each of the four support members (only 12, 13 and 14 shown in FIG. 1) into which can fit snugly the upper portion of each of the support members as shown in FIG. 11.

Figure 14:
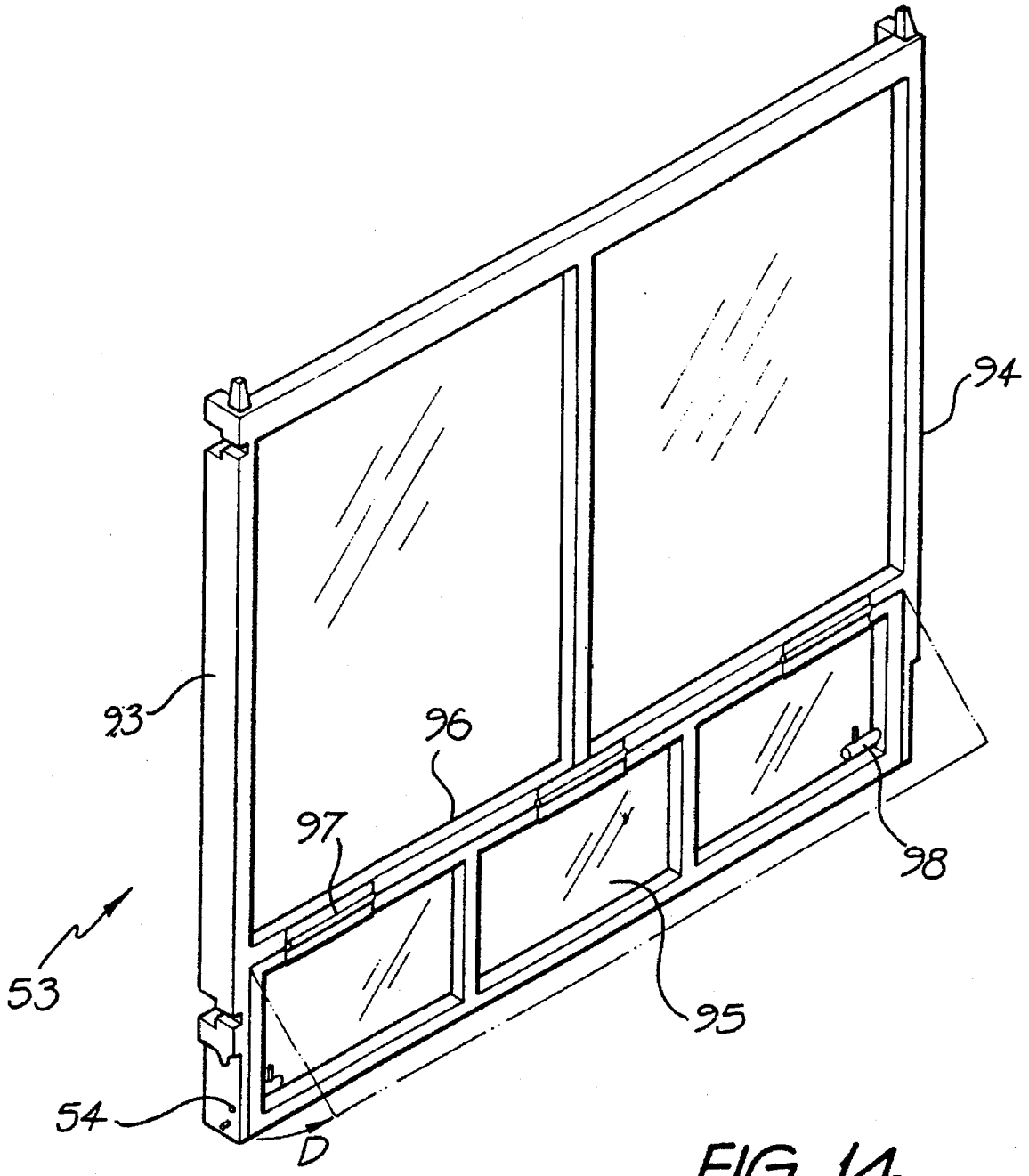
FIG. 14 is an isometric view of a preferred panel for use in the collapsible cage according to the invention.

In another embodiment of the invention, one or more of the side panels may include continuous solid sheet material in place of the meshwork, or a plurality of sheet material, as shown in FIG. 14. For instance, reinforced sheet steel or timber may be used. This may be particularly advantageous where leak prone liquids or powders and the like contained in flexible soft containers are to be transported or stored in the collapsible cage of the invention. A sheet steel panel 53 having a reinforcing steel inner frame structure is shown in FIG. 14.

The panel side members 93 and 94 of the panel 53 are constructed substantially in accordance with the panel side members of stationary panel 16*a* so that the panel 53 can be pivoted and lowered in similar fashion. A trap door 95 extending between side members 93 and 94 is pivotally connected to an inner frame cross member 96 by hinges 97. The trap door 95 may pivot outwardly as shown by arrow D to allow the release of materials stored in the cage. There are a pair of locking bars 98 connected at opposite ends of the trap door 95 that can slidably engage into holes in the side members 93 and 94 (only opposite end of hole 54 shown) so as to secure the trap door 95 to the panel side members 93 and 94.

Various other modifications may be made in details of design and construction without departing from the scope or spirit of the invention.

I claim:

1. A collapsible generally rectangular cage comprising a base, and successive first, second, third and fourth side panels adapted to be supported on said base in both an upright and collapsed position, vertically-oriented first pivoting means for connecting the adjacent vertical edges of said first and second side patois, and second vertically-oriented pivoting means for connecting the adjacent vertical edges of said third and fourth side panels, locking means adapted to allow the adjacent vertical edges of said second and third and first and fourth side panels to be locked into and unlocked from their upright position when forming the cage, said first and second pivoting means adapted to allow the adjacent ones of said first and second and third and fourth side panels to be pivoted into parallel generally vertical coplanar relationship as first and second pairs of side panels when said locking means is unlocked, said first pair being formed of said first and second side panels, and said second pair being formed of said third and fourth side panels, and collapsing means adapted to allow said coplanar first and second pairs of side panels to be collapsed onto and assume a substantially horizontally stacked over position over said base, and said first pivoting means includes a double axis hinge means that provides a first axis for rotation of said first side panel about said second side panel to enable said first side panel to pivot to a first outer position and a second axis for rotation of said first side panel about the second side panel to enable said first side panel to pivot from the first outer position to a second outer position where said first and second side panels are substantially coplanar to each other.

2. The collapsible cage of claim 1 including a top panel adapted to be supported on the side panels when the side panels are in an upright position, wherein the top panel is lockable by locking means and collapsible by collapsing means so that the side panels and top panel can assume a substantially horizontally stacked position over the base.

3. The collapsible cage of claim 1 wherein the locking means comprises a lockable member mounted on a first side panel and a recessed portion in an adjacent second side panel, the lockable member including catch means adapted to engage within the recessed portion, thereby locking said first side panel to the adjacent second side panel.

4. The collapsible cage of claim 3 wherein the locking means is adapted to lock a first side panel to an adjacent second side panel and wherein the lockable member includes vertical movement means that allow the catch means to be lowered into engagement with the recessed portion and to be raised so as to disengage from the recessed portion.

5. The collapsible cage of claim 4 wherein vertical movement of the lockable member is biased by spring means that opposes raising of the lockable member, but favours lowering of the lockable member.

6. The collapsible cage of claim 5 wherein the lockable member includes rod means for engaging an opening in the base, so that when the catch means is lowered into engagement with the recessed portion, the rod means is lowered into engagement with the opening in the base, and when the catch means is raised so as to disengage from the recessed portion, the rod means is raised so as to disengage from the opening in the base.

7. The collapsible cage of claim 1 or claim 2 including guide means adapted to cooperate with the locking means, whereby the guide means ensure that the panels are properly orientated in their cage forming position before the panels are locked or unlocked by the locking means.

8. The collapsible cage of claim 7 wherein the guide means comprises a male portion protruding from a first panel and a female portion recessed in an adjacent second panel and adapted to engage the male portion, the male portion being adapted to be moved in a horizontal plane with opening and closure of the first panel so that the male portion will disengage and engage respectively the female portion.

9. The collapsible cage of claim 1 wherein at least one of the side panels includes a subpanel, the at least one side panel having a frame, a portion of which frame pivotally supports the subpanel, and wherein the subpanel is lockable to the frame of the side panel by locking means, the locking means comprising a lockable member mounted on the subpanel and a recessed portion in the frame of the side panel, the lockable member including catch means adapted to engage within the recessed portion, thereby locking the subpanel to the side panel.

10. The collapsible cage of claim 1 or claim 2 wherein the collapsing means includes means for pivoting a first side panel about an adjacent second side panel so that the said first and second side panels are substantially coplanar to each other and means for lowering the substantially coplanar panels onto the base, so that the panels assume a substantially horizontally stacked position over the base.

11. The collapsible cage of claim 2 wherein the top panel, when unlocked, is collapsible by collapsing means which include means for pivoting the top panel about an adjacent side panel or about adjacent coplanar side panels so that the top panel and adjacent side panel or adjacent coplanar side panels aye substantially coplanar to each other, and means for lowering the so formed substantially coplanar panels onto the base.

12. The collapsible cage of claim 1 wherein said double axis hinge means allows said first side panel to pivot to either a first or second coplanar position with respect to said second side panel, said first coplanar position characterized by said first side panel rotating 270° about said pivot means such that the outer surfaces of said first and second side panels are in an abutting relationship, and said second coplanar position characterized as said first side panel rotating 90° about said pivot means such that the inner surfaces of said first and second side panels are in an abutting relationship.

13. The collapsible cage of claim 1 wherein the double axis hinge means comprises a first member mounted to the first side panel, a second member mounted to the second side panel and a third member pivotally connected about the first axis of rotation to the first member and pivotally connected about the second axis of rotation to the second member.

* * * * *